US005149001A

United States Patent [19]

Banba et al.

[11] Patent Number: 5,149,001

[45] Date of Patent: Sep. 22, 1992

[54] METHOD AND APPARATUS FOR SEPARATION OF DOUBLED YARN

[75] Inventors: Susumu Banba, Kyoto; Junichi Teranishi, Ohtsu; Shoji Sakai, Nagaokakyo; Makoto Uramoto, Uji; Hiroshi Uchida, Oumihachiman, all of Japan

[73] Assignee: Murata Kikai Kabushiki Kaisha, Kyoto, Japan

[21] Appl. No.: 614,192

[22] Filed: Nov. 14, 1990

[30] Foreign Application Priority Data

| | | | |
|---|---|---|---|
| Nov. 15, 1989 | [JP] | Japan | 1-294965 |
| Nov. 22, 1989 | [JP] | Japan | 1-304338 |
| Dec. 25, 1989 | [JP] | Japan | 1-336101 |
| Jan. 18, 1990 | [JP] | Japan | 2-9350 |
| Jan. 18, 1990 | [JP] | Japan | 2-9351 |
| Jan. 18, 1990 | [JP] | Japan | 2-9352 |
| Feb. 22, 1990 | [JP] | Japan | 2-41987 |

[51] Int. Cl.[5] ..... B65H 54/00

[52] U.S. Cl. ..... 242/42; 57/22; 57/261; 242/35.6 R

[58] Field of Search ..... 242/42, 35.6 R, 35.5 R, 242/128, 54 R; 57/328, 261, 22

[56] References Cited

U.S. PATENT DOCUMENTS

| | | | |
|---|---|---|---|
| 276,171 | 4/1883 | Fraser | 229/120.09 |
| 1,256,965 | 2/1918 | Williams | 206/256 |
| 1,863,190 | 6/1932 | Coulapides | 206/264 |
| 2,009,835 | 7/1935 | Burke | 206/264 |
| 2,046,484 | 7/1936 | Ringler | 206/264 |
| 2,109,583 | 3/1938 | Bennett | 206/813 |
| 2,565,509 | 8/1951 | Marcin | 206/813 |
| 2,605,897 | 8/1952 | Rundle | 206/264 |
| 2,895,601 | 7/1959 | Krukonis | 206/273 |
| 2,959,338 | 11/1960 | Thurston | 229/120.09 |
| 2,984,340 | 5/1961 | Carmichael | 206/264 |
| 3,113,673 | 12/1963 | Stein | 206/65 |
| 3,144,190 | 8/1964 | Holt et al. | 229/27 |
| 3,221,876 | 12/1965 | Currie | 206/431 |
| 3,266,010 | 12/1965 | Rogers, Jr. | 206/264 |
| 3,447,733 | 6/1969 | Smith et al. | 206/491 |
| 3,503,568 | 3/1970 | Galley | 242/74 |
| 3,759,379 | 9/1973 | Werth | 206/429 |
| 3,809,227 | 5/1974 | Begemann | 206/264 |
| 4,424,658 | 1/1984 | Focke | 53/398 |
| 4,441,611 | 4/1984 | Sommariva | 206/431 |
| 4,485,926 | 12/1984 | Lenzmeier | 206/602 |
| 4,631,900 | 12/1986 | Mattei et al. | 53/448 |
| 4,669,611 | 6/1987 | Flaherty | 206/449 |
| 4,738,359 | 4/1988 | Phillips, Jr. | 206/256 |
| 4,928,817 | 5/1990 | Focke | 206/264 |
| 4,932,534 | 6/1990 | Focke et al. | 206/602 |
| 5,044,148 | 9/1991 | Fujiwara | 57/22 |

FOREIGN PATENT DOCUMENTS

| | | | |
|---|---|---|---|
| 1-39824 | 6/1989 | Japan | 57/261 |
| 358560 | 10/1931 | United Kingdom . | |

*Primary Examiner*—Stanley N. Gilreath
*Attorney, Agent, or Firm*—Spensley Horn Jubas & Lubitz

[57] ABSTRACT

Method and apparatus for separating a doubled yarn into single yarns in order to piece a doubled yarn. The doubled yarn is separated by separating members such as a clamper opened and closed in a manner of scissors, push- and separate member having an extreme end sharpened, and a plurality of yarn separating rollers having tapered portions being placed in contact with each other. Feelers or sensors may be located to provide a yarn separation signal.

11 Claims, 14 Drawing Sheets

METHOD AND APPARATUS FOR SEPARATION OF DOUBLED YARN

FIELD OF THE INVENTION

The present invention relates to a method and apparatus for separating a doubled yarn into single yarns in order to piece a doubled yarn every single yarn.

RELATED ART STATEMENT

When yarns are cut during winding spun yarns in a state of doubled yarns on a package or the like, they have to be pieced. In such a case, there is a method for piecing two of yarns on the delivery side and yarns on the winding side into one yarn. If this piecing means is employed, twisting in a post-step constitutes an obstacle, which is not preferable.

To cope with such a situation as described above, it is necessary to piece a single yarn on the delivery side and a single yarn on the winding side separately one by one. To this end, doubled yarns have to be positively separated into respective single yarns.

OBJECT OF THE INVENTION

It is an object of this invention to provide a method for positively separating a doubled yarn into respective single yarns.

It is another object of the present invention to prevent trouble in piecing occurring in a two-ply spinning machine by detecting in advance a separated state of yarns introduced into the piecing apparatus.

BRIEF DESCRIPTION OF THE DRAWINGS

The drawings show embodiments for carrying out the method and apparatus according to the present invention.

DETAILED DESCRIPTION OF PREFERRED EMBODIMENTS

Figure 1:
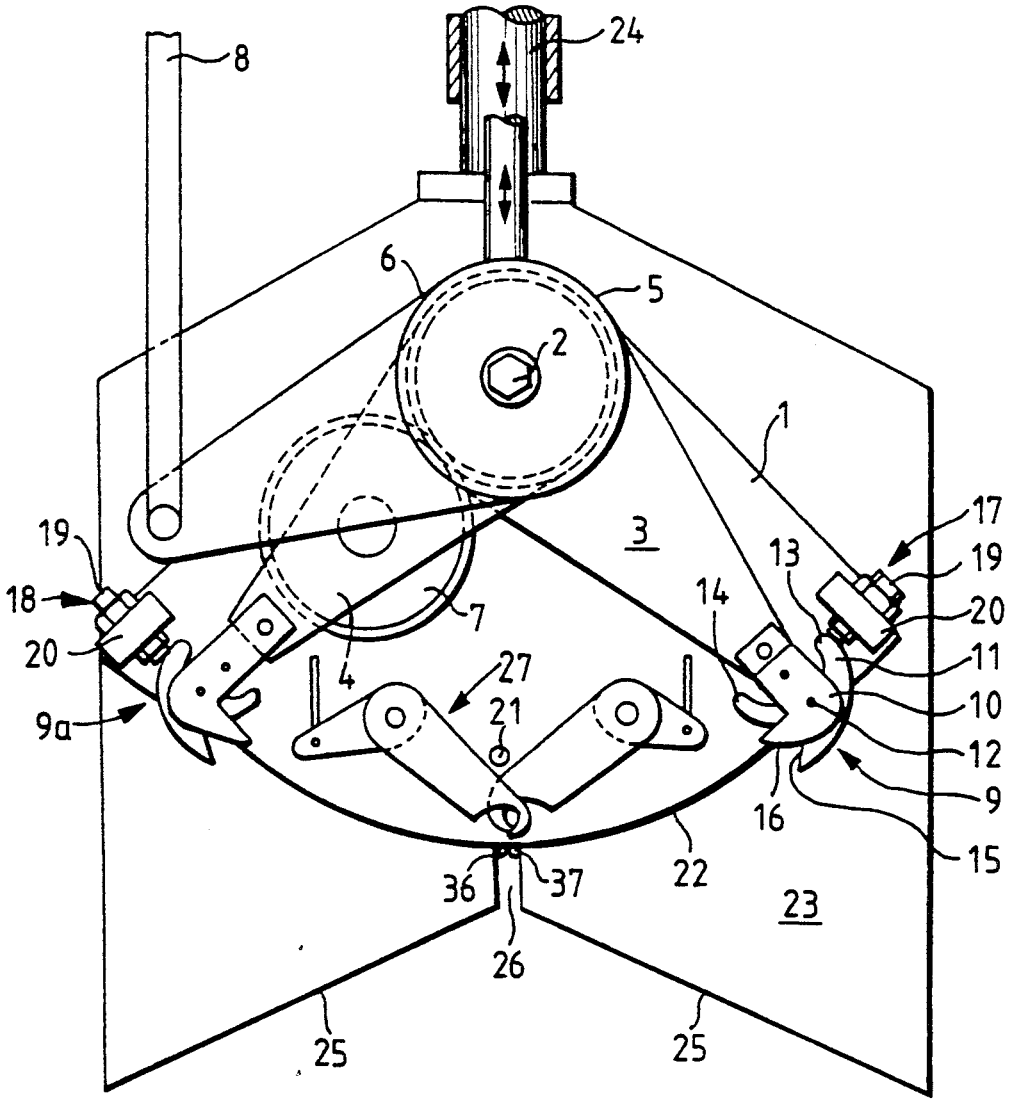
FIG. 1 is a plan view showing the state where doubled yarn starts to be separated.

The method of a first embodiment of the present invention comprises moving a clamper opened and closed toward a double yarn, locating the doubled yarns within an opening of the clamper and thereafter closing the opening, clamping one yarn positioned in an inner part of the opening more firmly than the other yarn, moving the clamper backward to thereby separate the more firmly clamped yarn from the other yarn, moving a yarn guide clamper adjacent the end portion of a yarn clamping portion of said clamper, and moving the yarn guide clamper so as to follow the yarn clamping portion as it moves backward.

The clamper is moved toward a doubled yarn, and the doubled yarn is located within an opening of the clamper and the clamper is closed. At that time, a single yarn located in the inner part of the opening of the clamper is different in clamping pressure from that of a single yarn located near the outside of the opening so that the single yarn located in the inner part of the opening of the clamper is firmly clamped. When the clamper is moved in that state, the single yarn located near the outside of the opening of the clamper cannot be clamped by the clamper because of weak clamping pressure and the aforesaid single yarn is escaped from clamping by the clamper and stays at the original position whereas only the single yarn located in the inner part of the opening of the clamper moves as the clamper moves. When the yarn is disengaged from the clamper due to the causes such as variation in tension of yarn during movement of the clamper, the yarn moves onto the end portion simultaneously with the movement of the clamper and engages with an engaging groove of the yarn guide clamper which moves following the clamper whereby two single yarns are positively separated from each other.

The method of the present invention will be described hereinafter together with the first embodiment of an apparatus for carrying out the method of the present invention.

In the first illustrated embodiment shown for example in FIGS. 1–5, two single yarns which have been doubled are separated sideway.

Two oscillating arms 3 and 4 are supported by means of a shaft 2 in required portions of a fan-shaped upper guide plate 1. The oscillating arm 3 is oscillatably supported on the shaft 2 through a gear 5 provided integral with a bearing portion, and a fixed gear 6 is provided coaxially with the gear 5 on the shaft 2. The oscillating arm 4 supported on the shaft 2 is capable of being oscillated separately from the oscillating arm 3, and a gear 7 is supported in the central portion of an arm body. The gear 7 is meshed with the gear 6. A connecting rod 8 is provided on an extended end of the oscillating arm 3. The rod 8 is fixed in position.

Clampers 9 and 9a are provided on the extreme ends of the oscillating arms 3 and 4. The clampers 9 and 9a have the same construction to hold a movable plate 11 between two fixed plates 10, the movable plate 11 being oscillatably supported by a shaft 12. The movable plate 11 is of a substantially Y-shape, in which left and right projections 13 and 14 in the form of a Y-shape are placed in contact with pins or the like described later so that the movable plate 11 may be turned about the shaft 12, and a clamping edge 15 is opposed to a clamping edge 16 of the fixed plate 10 to thereby clamp a yarn.

Clamp openers 17 and 18 are provided on the side of the upper guide plate 1. The clamp openers 17 and 18 are provided such that a bolt 19 is adjusted in projected position by a support member 20. When the extreme end of the bolt 19 comes into contact with one Y-shaped projection 13 of the movable plate 11, the movable plate 11 is turned to move the clamping edge 15 from the clamping edge 16 of the fixed plate 10. A clamping pin 21 is provided in the central portion of the extreme end of the upper guide plate 1. The clamping pin 21 comes into contact with the projection 14 of the movable plate 11 conversely to the former to move the clamping edge 15 toward the clamping edge 16 of the fixed plate 10 to clamp a yarn therebetween. A front edge 22 of the upper guide plate 1 constitutes a guide edge of a yarn.

A blade-like lower guide plate 23 is provided below the upper guide plate 1. The lower guide plate 23 is supported by a support member 24 and has an open V-shaped guide edge 25 at the extreme end thereof, and a yarn guide groove 26 is provided in the inner part of the V-shaped guide edge 25.

Figure 2:
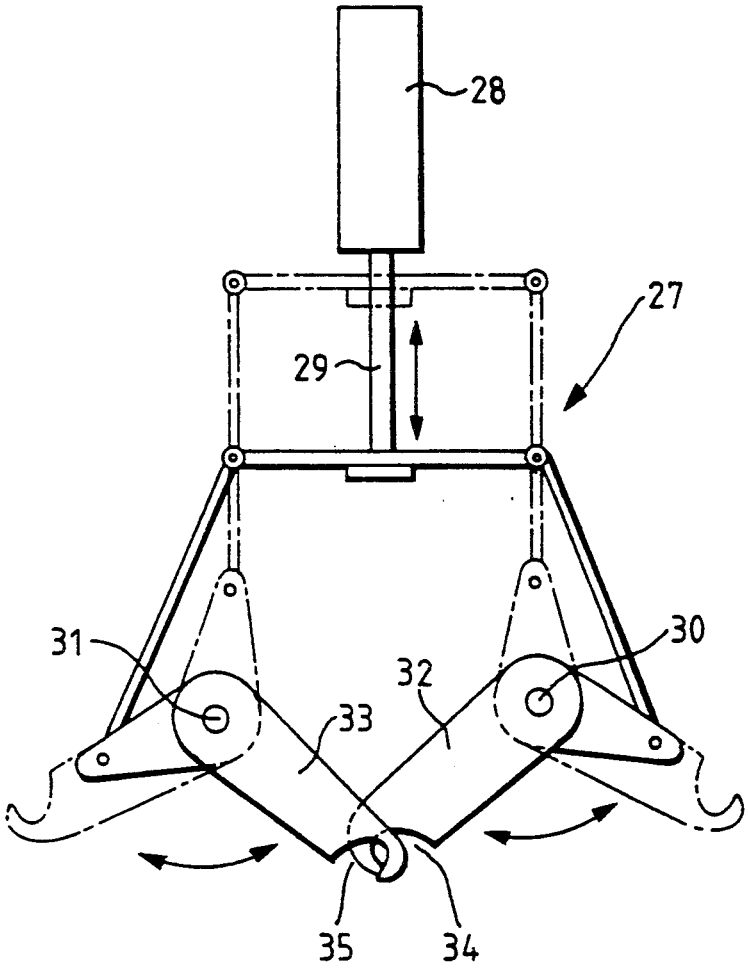
FIG. 2 is a plan view of a yarn guide clamper.
Figure 3:
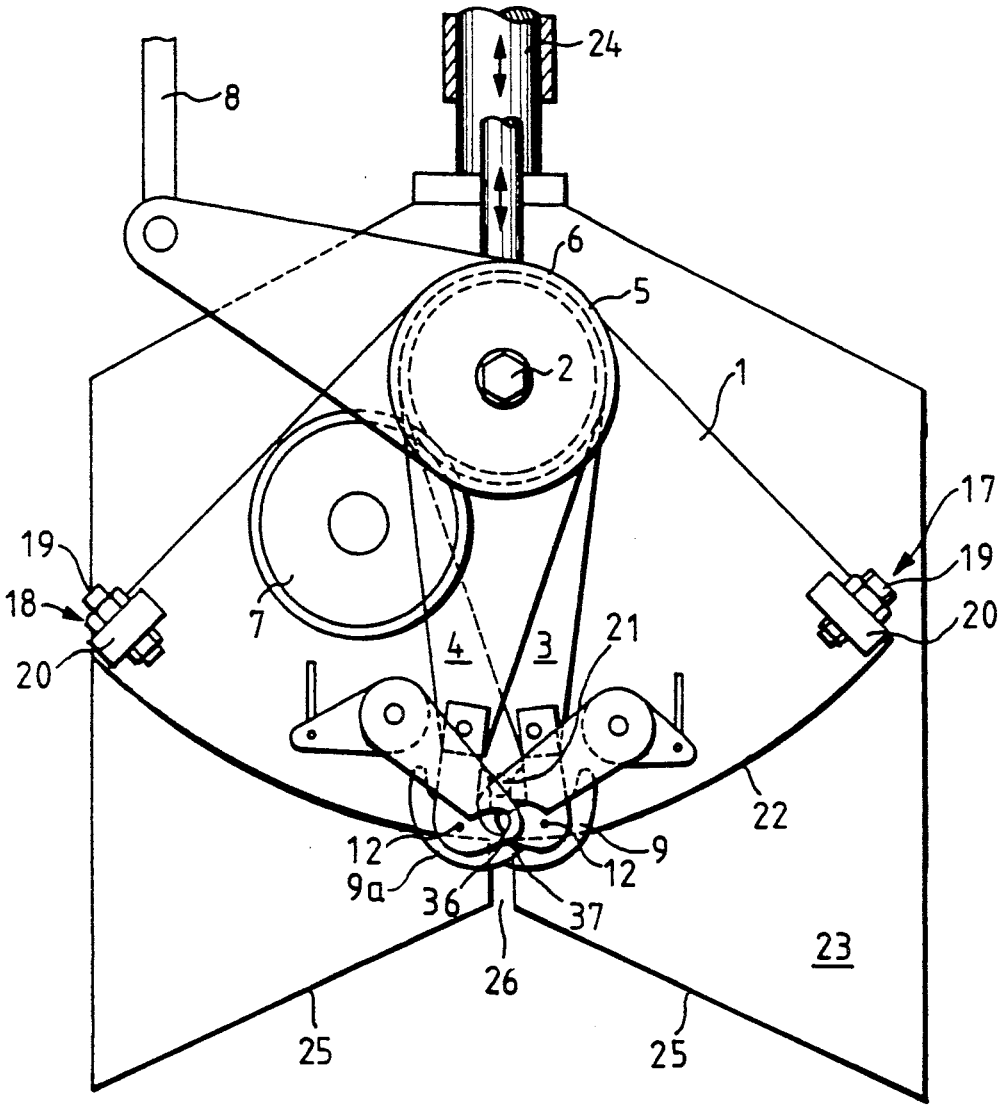
FIG. 3 is a plan view showing the state where each single yarn is clamped by a clamper.

The separating apparatus is provided with a yarn guide clamper 27. The yarn guide clamper 27 comprises arms 32 and 33 which are rotated about shafts 30 and 31 by forward and backward movement of a cylinder rod 29 of an air cylinder 28 as shown in FIG. 2. Yarn engaging grooves 34 and 35 at the extreme ends of the arms 32 and 33 are positioned so as to follow and move along the locus as the clampers 9 and 9a with the yarns clamped thereon move.

In the case where doubled yarns comprising two single yarns 36 and 37 are separated to left and right, the upper guide plate 1 and the lower guide plate 23 are moved toward the doubled yarns 36 and 37 to cause the latter to be moved into the innermost yarn guide groove 26 by the V-shaped guide edge 25 of the lower guide plate 23. The movement of the upper guide plate 1 is formed into a clockwise turning about the shaft 2 of the oscillating arm 3 through the rod 8, and the clampers 9 and 9a having been positioned as shown in FIG. 1 move close to a position of the oscillating arm shown in FIG. 3, that is, to the guide groove 26. The turning of the oscillating arm 3 rotates the gear 5 integral therewith so as to rotate the gear 7 meshed with the gear 5. However, since the gear 7 is also meshed with the fixed gear 6, the oscillating arm 4 is turned counterclockwise opposite to the turning of the oscillating arm 3 about the shaft 2. As a result, both the oscillating arms 3 and 4 cause the clampers 9 and 9a provided at the extreme ends thereof to move close to the doubled yarns 36 and 37 located in the central portion of the upper guide plate 1. At that central position, the projection 14 of the movable plate of the clampers 9 and 9a comes into contact with the clamping pin 21 to cause the movable plate 11 to turn about the shaft 12, and the single yarns 36 and 37 are clamped by the clamping edge 15 and the clamping edge 16 of the respective fixed plates 10. Since at this time, the single yarns 36 and 37 are in contact with the guide edge 22 at the front edge of the upper guide plate 1, they always assume a state where they are laterally arranged. The single yarns located on left and right sides are clamped by the clampers which move closer from left and right sides.

Figure 4:
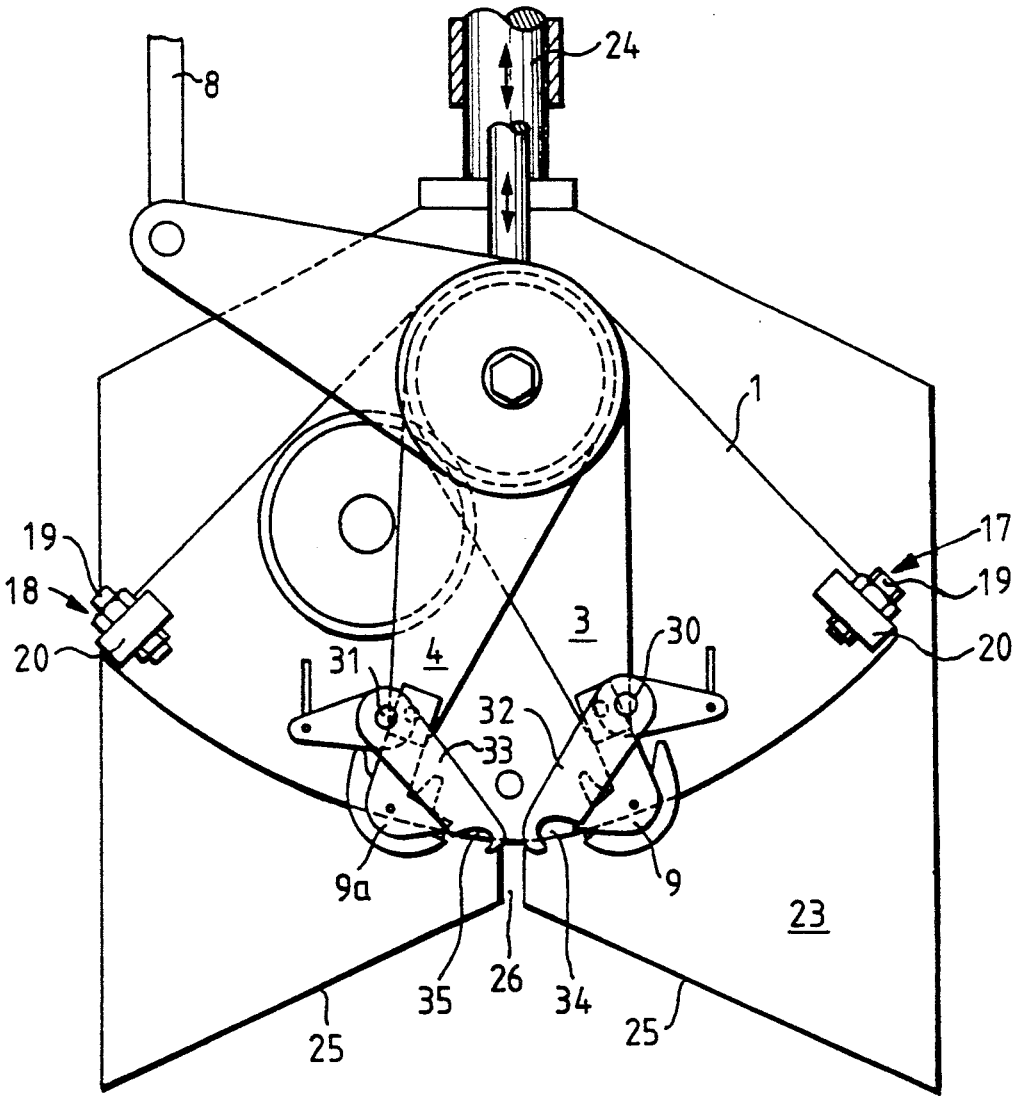
FIG. 4 is a plan view showing the state where said clamper starts to be moved away.
Figure 5:
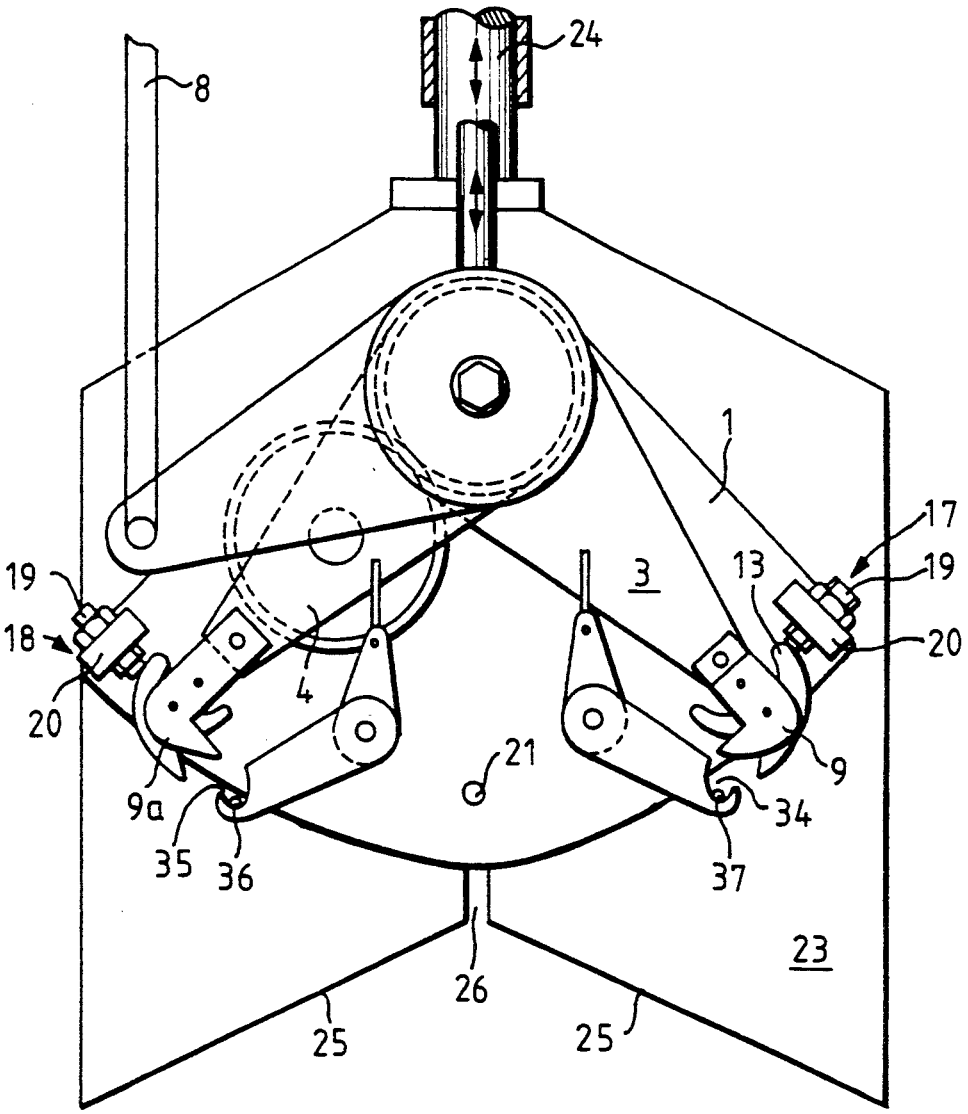
FIG. 5 is a plan view showing the state where said clamper has completed its disengagement.

When both the guide plates 1 and 23 are moved backward, the oscillating arms 3 and 4 rotate outwardly. When the clampers 9 and 9a with the single yarns 36 and 37 clamped thereto start to be moved away from each other, an air cylinder of the yarn guide clamper 27 shown in FIG. 2 is actuated so that as shown in FIG. 4, the arms 32 and 33 rotate about the shafts 30 and 31 to cause the yarn engaging grooves 34 and 35 at the extreme ends of the arms to move onto the moving locus of the clampers 9 and 9a to follow the movement of the clampers 9 and 9a. When the clampers 9 and 9a assume both left and right positions of the upper guide plate 1, the clampers 9 and 9a open whereby the single yarns 36 and 37 are released from the and engaged with the yarn engaging grooves 34 and 35 of the yarn guide clamper 27. Then, the single yarns 36 and 37 delivered to a splicer not shown.

According to the method of the present invention, even if the clampers 9 and 9a with the single yarns 36 and 37 clamped thereto are moving in the opposite direction, when the single yarns 36 and 37 are disengaged from the clampers 9 and 9a for some causes such as variation of yarn tension or the like, the yarn engaging grooves 34 and 35 of the yarn guide clamper 27 which follows the clampers 9 and 9a to move receive and engage the single yarns 36 and 37. Therefore, separation of the yarns can be more positively carried out.

While in the above-described embodiment, the yarn guide clamper 27 has been actuated by the air cylinder 28, it is to be noted that not only the air cylinder but other suitable fluid cylinders may be employed. Of course, cylinders are provided on the arms 32 and 33, respectively, instead of the arrangement wherein two arms 32 and 33 are actuated by a single cylinder 28 as shown in FIG. 2, so that they may be synchronized and operated.

The method of the first embodiment of the present invention comprises moving a clamper opened and closed in a manner of scissors in an open state toward the doubled yarn, locating the doubled yarn within an opening of the clamper and thereafter closing the opening, clamping one yarn positioned in the inner part of the opening among two yarns more firmly than the other yarn, moving the clamper backward to thereby separate the more firmly clamped yarn from the other yarn, moving a yarn guide clamper onto the end portion of a yarn clamping portion of said clamper, and moving the yarn guide clamper following said yarn clamping portion. Therefore, even when the clamper moves close to the doubled yarn from both sides to divide the doubled yarns into single yarns and the single yarns are disengaged from the clamper during separation, the single yarns are engaged with the engaging grooves of the yarn guide clamper whereby separation of the doubled yarn into single yarns can be more positively carried out. Therefore, the separation can be carried out every single yarn during piecing of doubled yarn.

Next, a second embodiment of the present invention will be illustrated referring to FIGS. 6 to 12. The embodiment of the present invention provides an apparatus comprising a groove for bringing doubled yarn into contact with each other to align constituent yarns thereof, and a push- and separate member inserted between the constituent yarns aligned within said groove to push and separate the constituent yarns, said push- and separate member having an extreme end sharpened.

When the doubled yarn is brought into contact with the groove, the constituent yarns of the doubled yarn are juxtaposed widthwise of the groove. When the sharpened push and separate member is inserted between the constituent yarns within the groove, the constituent yarns are separated from each other by the push- and separate member.

In this manner, the doubled yarn can be separated into two constituent yarns automatically. Therefore, the separation of the doubled yarn and piecing operation in the doubler can be fully automated.

Figure 6:
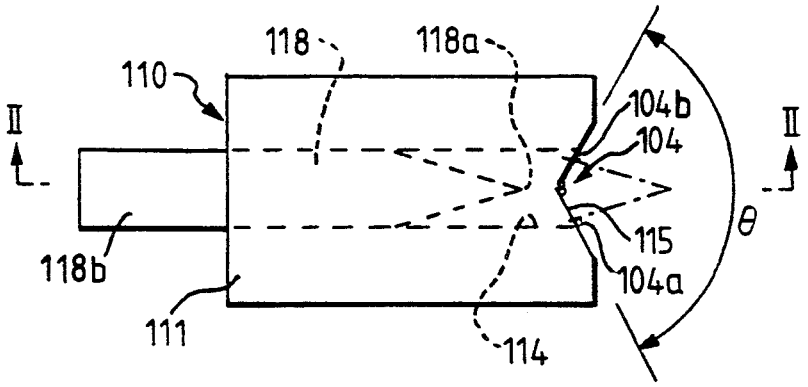
FIG. 6 is a plan view showing a second embodiment of a doubled yarn separating apparatus according to the present invention.
Figure 7:
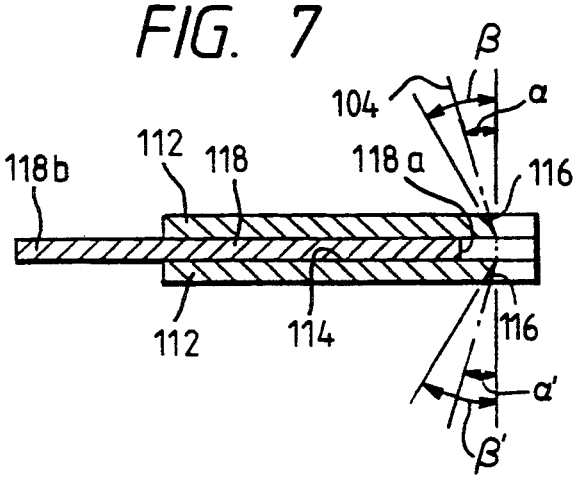
FIG. 7 is a sectional view taken on line VII—VII of FIG. 6.
Figure 8:
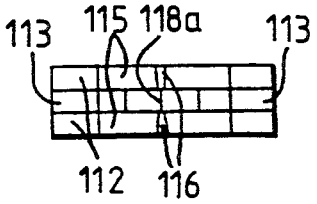
FIG. 8 is a front view of the apparatus.
Figure 9:
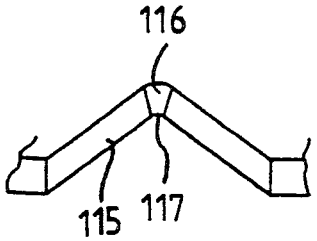
FIG. 9 is an enlarged perspective view of the groove.

In FIGS. 6 to 8, reference numeral 110 designates an apparatus for separating a doubled yarn, a body 111 of which comprises two side plates 112 and 112 connected through a pair of spacers 113 and 113. The body 111 is interiorly formed with a passage 114 defined by the side plate 112 and the spacer 113 and in communication in a longitudinal direction. Both the side plates 112 and 112 are formed in one end with V-shaped grooves 115 and 115 having an open angle of $\theta$, and a doubled yarn 104 is brought into contact with the groove 115 whereby two constituent yarns 104*a* and 104*b* constituting the double yarn 104 are juxtaposed widthwise of the groove 115. The open angle $\theta$ is preferably 45° to 150°. The shape of the groove 115 may be of U-shape, circular shape, etc.

More specifically, the central portion of the groove 115 is positioned in the central portion widthwise of the passage 114, and the groove 115 is formed in the central portion with inclined surfaces 116 and 116 inclined at predetermined angles of inclination $\beta$, $\beta'$ thicknesswise of the side plate 112. Let $\alpha$, and $\alpha'$ be the approach angles to the groove 115 of the doubled yarn 104, the relationships of $\alpha<\beta$, and $\alpha'<\beta'$ are preferred.

When the doubled yarn 104 is stretched so as to bridge between the grooves 115 and 115 of both the side plates 112 and 112, the constituent yarns 104*a* and 104*a* come into contact an edge 117 (see FIG. 9) on the passage 114 side of the inclined surface 116 and are juxtaposed along the edge 117.

A push- and separate member 118 having an extreme end sharpened is slidably inserted into the passage 114 within the body 111 in the state where an extreme end 118*a* thereof is positioned on the groove 115 side, and when the push- and separate member 118 is moved forward from a standby position at which the extreme end 118*a* is moved back from the groove 115, the extreme end 118*a* is inserted between the constituent yarns 104*a* and 104*b* juxtaposed within the groove 115 and the doubled yarn 104 is separated into two constituent yarns 104*a* and 104*b*. The push- and separate member 118 is configured so that a lengthy plate capable of being inserted into the passage 114 of the push- and separate member 118 is formed in one end thereof with an extreme end 118*a* of an equilateral triangle in plan. A rear end 118*b* of the push- and separate member 118 is extended from the body 111, and a cam for driving the push- and separate member 118 or a drive mechanism not shown formed from a cylinder or the like is connected to the rear end 118*b*.

According to such a configuration as described above, when the doubled yarn 104 is stretched so as to bridge between the grooves 115 and 115 of the side plates 112 and 112, the doubled yarn 104 comes into contact with the edge 117 of the inclined surface 116 so that the constituent yarns 104*a* and 104*b* are juxtaposed widthwise of the groove 115 along the edge 117. Then, when the push- and separate member 118 is advanced toward the groove 115 by a drive mechanism not shown, the sharpened extreme end 118*a* of the push- and separate member 118 is inserted between the constituent yarns 104*a* and 104*b* juxtaposed within the groove 115 to separate the doubled yarn 104 into two constituent yarns 104*a* and 104*b*.

In this manner, the doubled yarn 104 can be automatically separated into two constituent yarns 104*a* and 104*b*, and separation of the doubled yarn and piecing operation in the doubler can be fully automated.

Figure 10:
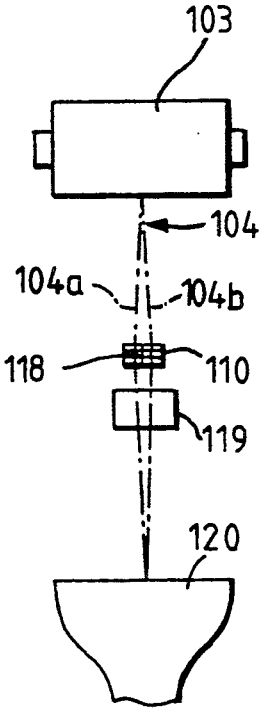
FIG. 10 is a view showing the state of an operation for separating the doubled yarn in a doubler with the apparatus mounted thereon.

FIG. 10 shows an embodiment in which the doubled yarn separating apparatus 110 configured above is mounted on a doubler.

The doubled yarn separating apparatus 110 and a piecing apparatus 110 are arranged up and down in a yarn running area 104 between a feed package not shown and the winding package 103. When a suction mouth 120 sucks an end of the cut doubled yarn 104 on the winding package side to pull it out of the winding package 103 along the yarn running area, the doubled yarn 104 is guided into the groove 115 of the doubled yarn separating apparatus 110 and the constituent yarns 104*a* and 104*b* are juxtaposed within the groove 115. In this state, the push- and separate member 118 is driven forward whereby the sharpened extreme end 118*a* of the push- and separate member 118 is inserted between the constituent yarns 104*a* and 104*b* juxtaposed within the groove 115. The constituent yarns 104*a* and 104*b* are then separated to left and right. Thereby, the constituent yarns 104*a* and 104*b* of the doubled yarn 104 in the state where they are separated to left and right are arranged on the piecing apparatus 119. Therefore, when the yarn end on the feed package side is likewise arranged to be separated to left and right on the piecing apparatus 119 by the suction mouth, the yarn ends can be separately pieced by the piecing apparatus 119. As the case may be, piecing can be made so as to be deviated in joint.

Figure 11:
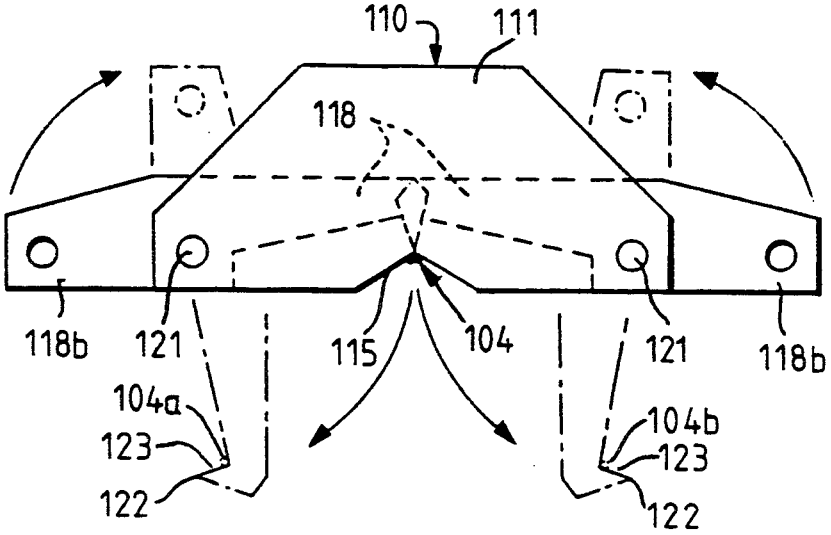
FIG. 11 is a plan view showing another embodiment of the doubled yarn separating apparatus.
Figure 12:
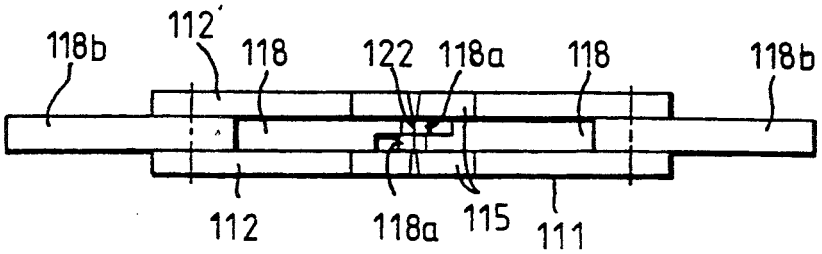
FIG. 12 is a view showing a piecing state in a doubler.

FIGS. 11 and 12 show another embodiment of the doubled yarn separating apparatus.

The body 111 has both side plates 112 and 112 connected at the rear through a spacer not shown. A groove 115 is formed in the central portion of the front end of both the side plates 112 and 112. The groove 115 has the same construction as that of the above-described embodiment. A pair of left and right push- and separate members 118 and 118 are rotatably mounted by shafts 121 and 121 between both the side plates 112 and 112 frontwardly of the body 111. The extreme ends 118*a* of the push- and separate members 118 are formed so that they are placed one above the other at a standby position withdrawn from the groove 115, and a hook-like projection 122 faces to the central portion of the groove 115. A drive mechanism not shown is connected to other ends 118*b* and 118*b* of both the push- and separate members 118 and 118 to simultaneously rotate the latter.

According to such a configuration as described above, when both the push- and separate members 118 and 118 are rotated with respect to the constituent yarns 104*a* and 104*b* juxtaposed in the groove 115 about the respective shafts 121 and 121 as indicated by the phantom line, both projections 122 are inserted between the constituent yarns 104*a* and 104*b*, and then the left-hand push- and separate member 118 catches the left-hand constituent yarn 104*a* by a hook portion 123 of the projection 122 to separate it leftward whereas the right-hand push- and separate member 118 catches the right-hand constituent yarn 104*b* by a hook portion 123 of the projection 122 to separate it rightward, whereby the constituent yarns 104*a* and 104*b* can be separated largely to left and right.

In short, according to the present invention, the doubled yarn is brought into contact with the groove whereby the constituent yarns are juxtaposed and the push- and separate member having a sharpened end is inserted between the constituent yarns. Therefore, the doubled yarn can be automatically, positively and easily separated into two constituent yarns to render possible full automation of separation of doubled yarn and piecing operation in the doubler.

A third embodiment of the present invention will be described with respect to FIGS. 13 and 14. The third embodiment of the present invention provides an apparatus for separation of yarns comprising yarn separating rollers 203, 204, 205 and 206 provided to be superposed laterally and vertically adjacent a winding package P, said rollers having a peripheral surface with two tapered portions, said tapered portions being placed in contact with each other to form a clearance, said rollers rotated during piecing to hold fuzz of a yarn passing through said clearance to separate yarns, and feelers 201 and 202 are provided to detect the yarns, wherein when the feelers 201 and 202 simultaneously provide a yarn detection signal, the winding package and the yarn separating rollers 203, 204, 205 and 206 are stopped.

In the yarn separating apparatus configured as described above, when a slub catcher detects a cut of yarn or a defect of yarn and a suction mouth 207 sucks a yarn end on the package side to turn it toward a piecing device, the yarn separating rollers 203, 204, 205 and 206 rotate and yarns move into an opening between the separating rollers so that the fuzz of yarn is held between the yarn separating rollers 203, 204, 205 and 206 and accordingly the yarns are moved in a direction of moving away from each other. The separated yarns act on the feelers 201 and 202 whereby a yarn detection signal is provided. When said signal is generated at the same time, the winding package and the yarn separating rollers 203, 204, 205 and 206 are stopped.

Figure 13:
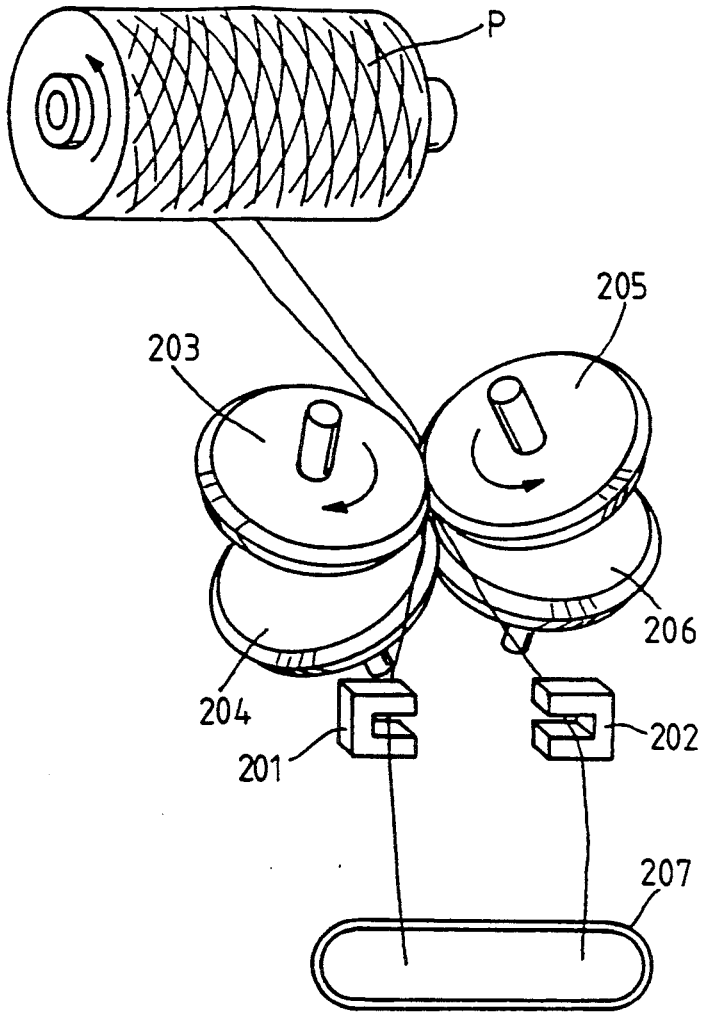
FIG. 13 is a schematic perspective view of a third embodiment of a yarn separating apparatus.

In a winder for doubling two yarns to wind them or a winding apparatus in a spinning machine for winding a doubled yarn, when the slub catcher detects a cut of yarn or detects a defect of yarn to automatically cut a running yarn, a suction pipe not shown sucks a yarn end on the feed side whereas a yarn end wound into the package P is sucked by the suction mouth 207 as shown in FIG. 13 while being rewound, and both the yarns are turned and introduced into a piecing device not shown. The yarn ends are then separately pieced.

In order to separately piece the yarns in the piecing device as described above, separation of the yarns has to be done by the yarn separating apparatus.

The yarn separating apparatus will be described with reference to FIGS. 13 and 14.

Two pairs of yarn separating rollers 203, 204 and 205, 206 are laterally arranged in a state where they are in contact with each other this side of the winding package P. Feelers 201 and 202 are provided further this side.

The feelers 201 and 202 generate an electric signal when a yarn enters into a clearance thereof.

Figure 14:
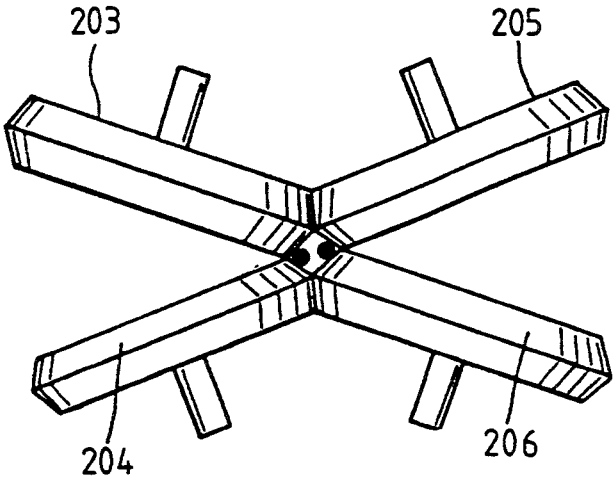
FIG. 14 is a side view of a yarn separating roller.

The two pairs of yarn separating rollers 203, 204 and 205, 206 are formed as shown in FIG. 14. That is, they comprise flat rollers formed with two tapered portions in a peripheral surface thereof. Their rotary shafts are inclined to each other as shown in FIG. 14, and the tapered portions on the shaft side of the yarn separating rollers 203, 204 and 205, 206 are in contact with each other. There is a clearance surrounded to a degree that two yarns as a whole may be passed therethrough. The yarn introduced therein has its fuzz held between the yarn separating rollers 203, 204 or 205, 206, and two yarns are dragged in a direction of moving away from each other as the rollers rotate. To obtain a sufficient function, the yarn separating rollers 203, 204, 205 and 206 are made of elastic material such as rubber so that the yarn separating rollers 203 and 204, and 205 and 206 are lightly pushed toward each other.

When the slub catcher senses a cut of yarn or detect a defect of yarn to suck the yarn end on the package side being rewound by a suction mouth 207 to introduce it into the piecing device, the yarn separating rollers 203, 204, 205 and 206 rotate in a direction as indicated by an arrow in FIG. 13, and the yarns pass between the yarn separating rollers 203 and 205 and are introduced into the clearance surrounded by four yarn separating rollers. As the yarn separating rollers 203, 204, 205 and 206 rotate, the fuzz of the yarns is held between the yarn separating rollers 203 and 204 or 205 and 206 and the yarns are dragged in a direction of moving away from each other. The yarn crosses the clearance of the feelers 201 and 202 to provide an electric signal. When the electric signal is generated at the same time, the winding package P and the yarn separating rollers 203, 204, 205 and 206 are stopped.

When one of the feelers 201 and 202 is actuated, two yarns are adhered to or incompletely separated. Therefore, the winding package P and the yarn separating rollers 203, 204, 205 and 206 are not stopped by a sole signal.

Since the present invention is configured as described above, it has the following effects.

That is, two yarns can be separated simply without requiring very delicate yarn nipping or the like by a mechanical member. This is very effective for yarns having a long fuzz.

A fourth embodiment of the present invention will be illustrated.

An apparatus of the fourth embodiment comprises feelers 303 and 304 provided opposedly of a yarn guide passage 302 adjacent a winding package P to sense that two yarns are separated during piecing to generate a yarn separation signal, and draw-apart members 305 to 308 or 310 positioned on the side of said feelers opposite the package to receive the yarn separation signal to draw-apart the yarns, wherein when the yarn separation signal is generated, the winding package is stopped.

In the yarn separating apparatus configured as described above, when the slub catcher senses a cut of yarn or detect a defect of yarn and a suction mouth 309 sucks a yarn end on the package side to turn it toward a piecing device, yarns are guided to a yarn guide passage 302. Separated portions of yarns are detected by the feelers 303 and 304, and when the separated portions are detected, the feelers 303 and 304 generate a yarn separation signal. Thereby, the yarn draw-apart members 305 to 308 or 310 act on the separated portions of yarns to draw them apart. At the time the yarn separation signal is generated, the winding package is also stopped.

The yarn separating apparatus will be described hereinafter with reference to FIGS. 15 and 16.

A yarn guide member 301 formed at an upper part with a relatively wide yarn guide passage 302 is provided this side of a winding package P, and a feeler comprising a projector 303 and a light receiver 304 is provided below the yarn guide passage 302. Clamps 305, 306, 307 and 308 are provided this side continuous to the yarn guide passage 302 of the yarn guide member 301.

The projector 303 projects light from under the yarn introduced to the yarn guide passage 302, and the light receiver 304 receives a light reflected therefrom to judge an overlapping state of two yarns. That is, greater the overlapping degree of two yarns larger the spreading of light received. If the two yarns are separated, the spreading of light increases. When the spreading of light is in excess of a predetermined value, judgement is made so that two yarns are separated, and a yarn separation signal is generated. An instruction is issued to the clamps 305, 306, 307 and 308 on the basis of the yarn separation signal. Simultaneously therewith, the winding package P is stopped.

Figure 15:
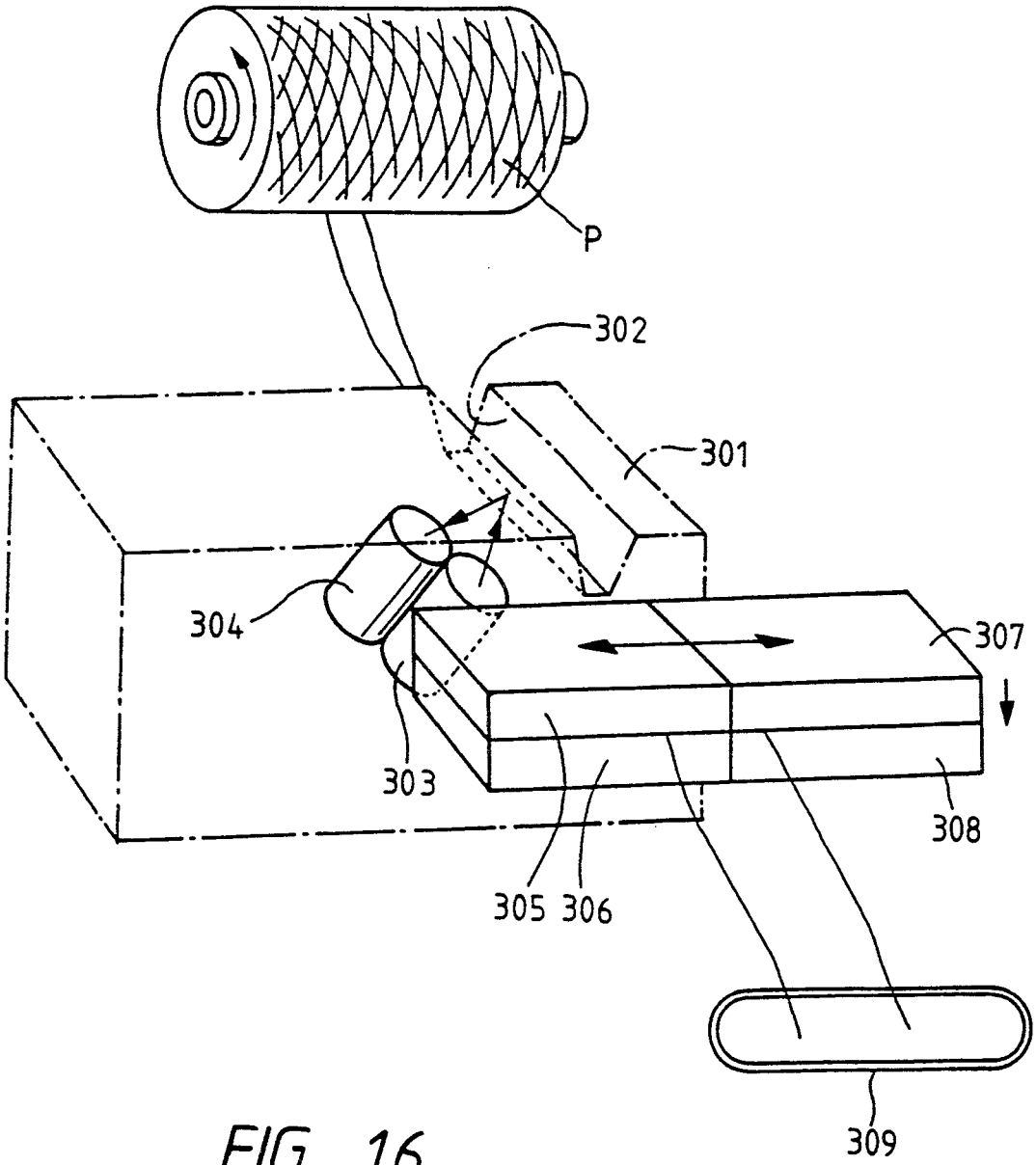
FIG. 15 is a schematic perspective view of a fourth embodiment of a yarn separating apparatus.
Figure 16:
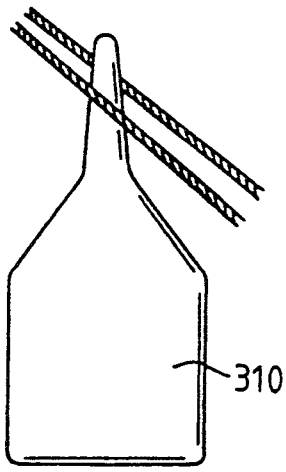
FIG. 16 shows a needle separator.

Four clamps 305, 306, 307 and 308 are provided to left and right and up and down as shown in FIG. 15. Normally, lower clamps 306 and 308 are in contact with each other, upper clamps 305 and 307 are above the lower clamps 306 and 306, and the clamps 305 and 307 are on the standby in the state where they contact with each other. However, when the light receiver 304 generates a yarn separation signal, the upper clamps 305 and 307 move down and a yarn is held between the lower clamps 306 and 308, after which the left clamps 305, 306 and the right clamps 307, 308 moved laterally in the paired relation. Preferably, the clamps 305, 306, 307 and 308 are made of elastic material such as rubber in order to improve the holding of yarns.

Alternatively, instead of drawing apart the yarns by the clamps 305, 306, 307 and 308, a needle separator 310 having a needle with an extreme end directed upwardly may be used which is moved upward by the yarn separation signal so as to separate yarns. Even at that time, the winding package P is stopped simultaneously with the yarn separation signal.

When the slub catcher senses a cut of yarn or detect a defect of yarn and a yarn end on the package P side being rewound is sucked by the suction mouth 307 to introduce the yarn into the piecing device, two yarns are guided into the yarn guide passage 302. A separated portion of the yarn is found by the projector 303 and the light receiving unit 304, and both yarns are further drawn apart by the clamps 305, 306, 307 and 308 or the needle separator 310. Simultaneously therewith, the winding package P is stopped.

Since this embodiment is configured as described above, it has the following effect.

That is, separation of yarns is found by the feeler and the separated portion is then drawn apart without depending on very delicated yarn nipping by the mechanical member as in the conventional yarn separating apparatus. Therefore, two yarns can be separated positively and simply.

Figure 17:
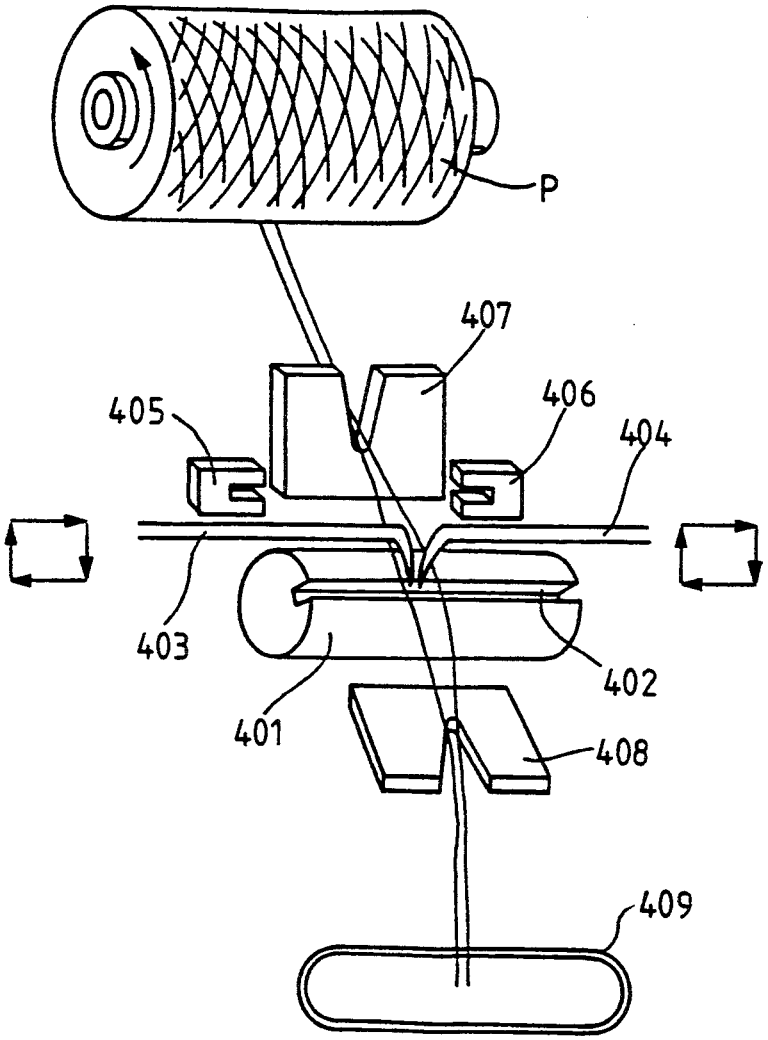
FIG. 17 is a schematic perspective view of a fifth embodiment of a yarn separating apparatus.

The fifth embodiment of the present invention will be described referring to FIG. 17.

An apparatus for separation of yarns of the embodiment comprises a guide block 401 having a needle guide groove 402 parallel with a shaft of the package P, feelers 405 and 406 provided in the vicinity of each end of the needle guide groove 402 to provide a yarn separation signal when a yarn is detected, and needles 403 and 404 which repeat approach and downward movement along the needle guide groove 402 till a yarn separation signal is provided during piecing and disengagement and upward movement in the needle guide groove 402, wherein the winding package P is stopped simultaneously with the yarn separation signal.

In the yarn separating apparatus configured as described above, when the slub catcher senses a cut of yarn or detect a defect of yarn and the suction mouth 409 sucks a yarn end on the package side to turn it toward the piecing device, the needles 403 and 404 repeat approach and downward movement along the needle guide groove 402 and disengagement and upward movement in the needle guide groove 42 till the feelers 45 and 46 generate a yarn separation signal. When two yarns are separated and the feelers 405 and 406 generate a yarn separation signal, the winding package P is also stopped.

The yarn separating apparatus will be described hereinafter with reference to FIG. 17.

A guide plate 407, feelers 405 and 406, a guide block 401, needles 403 and 404 and a guide plate 408 are provided in that order on one side of a winding package P.

The guide plate 407 and the guide plate 408 are provided to guide a yarn when a suction mouth 409 sucks a yarn end on the package P side to turn it.

The guide block 401 is formed in its upper surface with a needle guide groove 402 parallel with a shaft of the package P to guide the extreme ends of the needles 403 and 404 along the needle guide groove 402.

Normally, the needles 403 and 404 are parted to left and right and positioned above the needle guide groove 402. However, when a piecing signal is generated, two needles 403 and 404 move internally till the come into contact with each other along the guide groove 402, and then moves down into the needle guide groove 402. Thereafter, the needles are moved in a direction of separating from each other to left and right within the needle guide groove 402, and when they arrive at the end of the needle guide groove 402, the needles again move upward. Thereafter, this motion is repeatedly carried out.

The feelers 405 and 406 senses a yarn when the yarn is caught by the aforesaid motion of the needles 403 and 404 to move it to the end of the needle guide groove 402. When both feelers 405 and 406 sense a yarn, a yarn separation signal that the two yarns are separated is generated to stop motion of the needles 403 and 404. When the yarn separation signal is generated, the winding package P is also stopped. While in this embodiment, the feelers 405 and 406 are provided frontwardly of the needle guide groove 402, it is to be noted that they may be provided at the rear thereof.

When the slub catcher senses a cut of yarn or detect a defect of yarn and the suction mouth 407 sucks a yarn end on the package P side to introduce it into the piecing device, two yarns are guided along the guide plate 407 and the guide plate 408. Immediately thereafter, the needles 403 and 404 repeat approach and downward movement along the needle guide groove 402 and disengagement and upward movement in the needle guide groove 402 till both the feelers 405 and 406 sense a yarn to generate a yarn separation signal. The winding package P is also stopped simultaneously with the generation of the yarn separation signal.

Since this embodiment is configured as described above, it has the following effect.

That is, two yarns can be separated positively and simply without depending upon very delicate yarn nipping by the mechanical member.

When piecing is carried out by a two-ply spinning machine for doubling and winding yarns spun out of two spinning nozzles as previously mentioned, it is desired that two yarns on the delivery side and two yarns on the winding side are individually joined. Because of this, on the delivery side, individual yarns in a separated state are guided into the piecing apparatus and on the winding side, individual yarns are guided through a separator. However, the yarns on the delivery side as well as those on the winding side are sometimes not separated positively, and in such a case, piecing should be avoided.

A piecing method according to the present invention uses a plurality of piecing units corresponding to the number of yarns in order to individually piece a plurality of drawn yarns, the method comprising mounting yarn detection sensors on yarn running areas before and behind each piecing unit, and carrying out piecing operation only when all of said sensors sense yarns prior to entry into piecing operation.

The method of an embodiment of the present invention will be described hereinafter together with one example of apparatus for carrying out the method.

Figure 18:
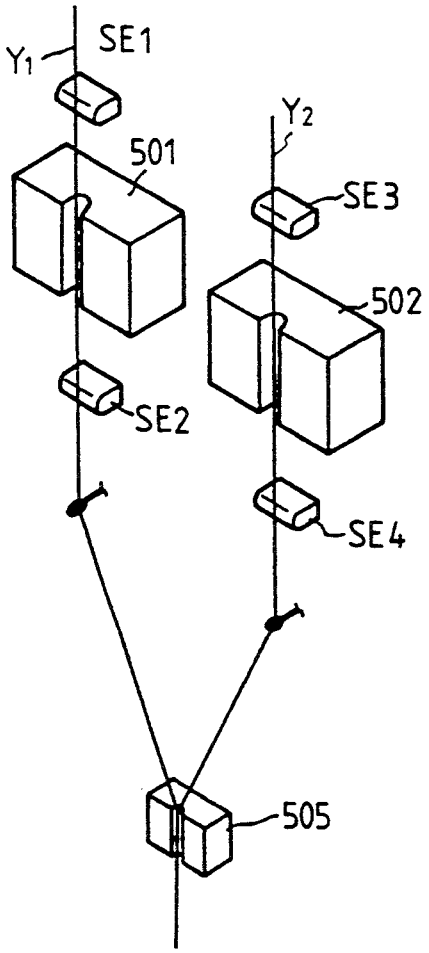
FIG. 18 is a schematic sketch of an embodiment the present invention.
Figure 19:
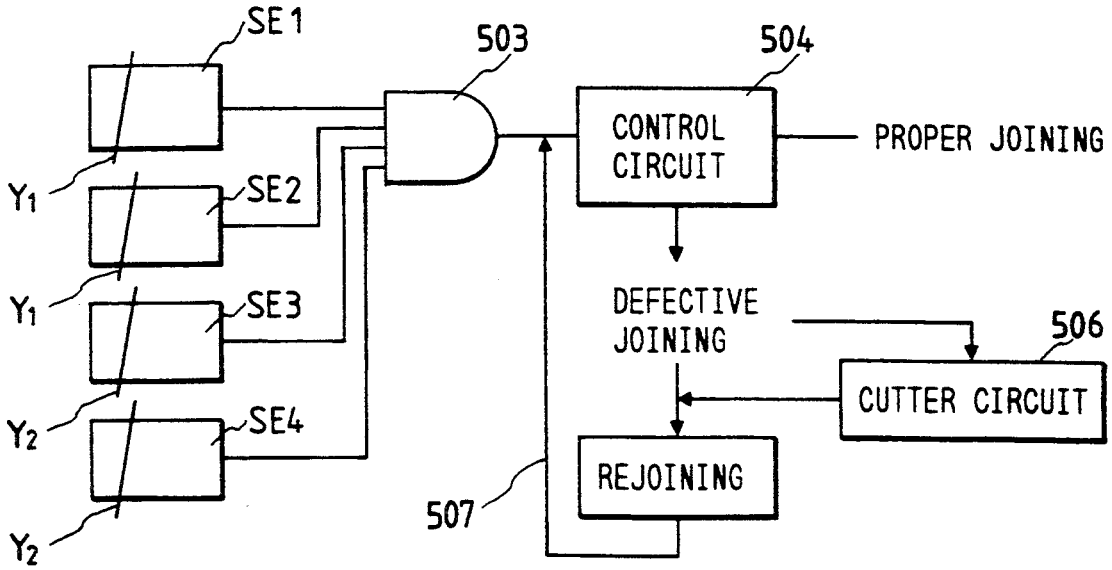
FIG. 19 is a block diagram showing a control system.

An example shown in FIG. 18 shows a piecing apparatus portion of a spinning apparatus. The apparatus is provided at downstream of a drafting part or the like not shown and comprises a first piecing unit 501 for piecing a first yarn $Y_1$ and a second piecing unit 502 for piecing a second yarn $Y_2$, the piecing units 501 and 502 being provided with yarn detection sensors SE1, SE2, SE3 and SE4 on yarn running areas before and behind thereof. The yarn detection sensors SE1, SE2, SE3 and SE4 are connected to a control circuit 504 via an AND circuit 503 (FIG. 19) to discriminate modes into a case where a cutter circuit 506 for actuating a cutter 505 in case where proper tying is not carried out and a yarn tying loop 507 is actuated and a case where proper tying is carried out according to presence or absence of a signal to the control circuit 504.

Figure 20:
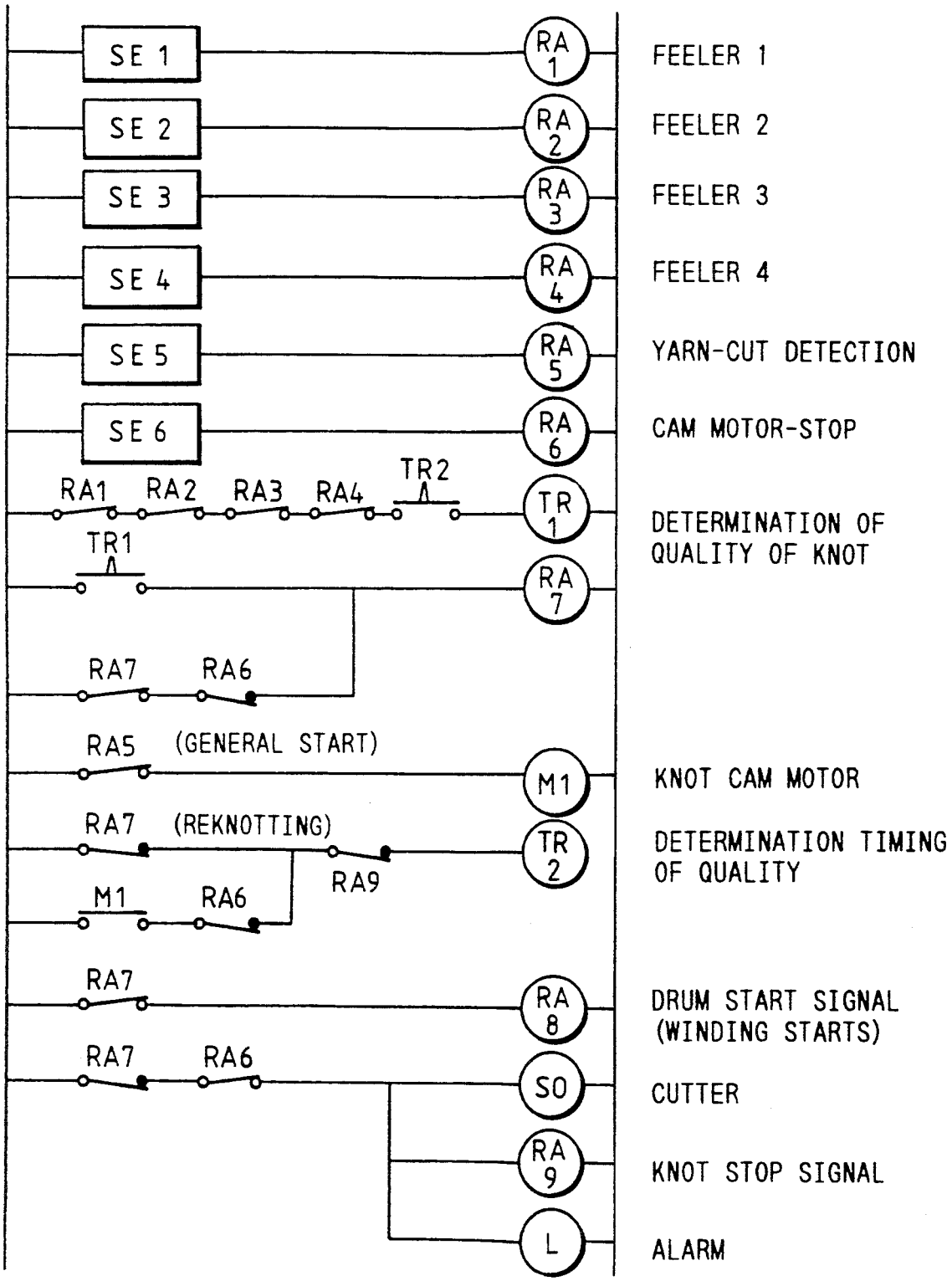
FIG. 20 is a control circuit of the present invention using relays.

The above-described control will be described with reference to FIG. 20.

First, the case will be described in which a cut of yarn is found, and piecing is completed by one piecing operation.

When a yarn-cut detection sensor SE5 detects a cut of yarn, one shot pulse is generated whereby a relay RA5 is actuated to turn on a switch RA5 to actuate a knot cam motor M1 and a timer relay TR2. A yarn separating unit of a yarn typing device is actuated by actuation of the knot cam motor M1 to introduce yarns into the piecing unit for piecing. When this piecing has been succeeded and yarns are introduced into sensors, all of sensors SE1, SE2, SE3, and SE4 are turned on to actuate relays RA1, RA2, RA3 and RA4 and switches RA1, RA2, RA3 and RA4 are turned on. On the other hand, the knot cam motor M1 is actuated by the turning-on of switch RA5 resulting from the actuation of the relay RA5. When the knot cam fully rotates and one circulation of piecing operation is terminated, such a state is detected by the sensor SE6 to actuate the relay RA6 and stop the cam motor M1. Switches RA6-1 and RA6-3 are turned on and RA6-2 is turned off by the actuation of the relay RA6. A timer relay TR2 is actuated simultaneously with turning-on of the switch RA5, and a switch TR2 is turned on after passage of a predetermined time (at least time required for piecing) from detection of yarn-cut. Since at this time, the switches RA1, RA2, RA3 and RA4 are turned on, the timer relay TR1 is actuated by turning-on of the switch TR2. The timer relay TR1 judges quality of piecing with sufficient time whereby the switch TR1 is turned on to actuate the relay RA7. Thereby, the switches RA7-1, RA7-2, RA7-3 and RA7-4 are actuated but the switch RA7-1 is turned on to thereby constitute a self-hold circuit of the relay RA7 together with the switch RA6-1. When the relay switch RA7-2 is turned, the relay RA8 is actuated to start a winding drum of a winding device.

Unsuccessful piecing results from the following.

When the yarn-cut detection sensor SE5 is actuated, the relay RA5 is actuated, the switch RA5 is turned, the relay TR2 is actuated and the switch TR2 is turned on, if any sensor which detects no yarn is present, either switch for the relays RA1, RA2, RA3 and RA4 is not turned on and therefore, the relay TR1 becomes inoperative. The inoperative relay TR1 causes the switch TR1 to be turned off and renders the relay RA7 inoperative. Then, the switches RA7-1 and RA7-2 are turned off and switches RA7-3 and RA7-4 turned on. The switch RA7-2 is turned off and the relay RA8 for driving a winding drum becomes inoperative and therefore winding is not effected. Since the switch RA-4 is turned on and RA6-3 is turned on, a solenoid for actuating a cutter is actuated to cut a yarn. The switch RA7-3 is turned on and when the first piecing is unsuccessful, the switch RA9 is turned on. Therefore, the timer relay TR2 is actuated and at the same time the knot cam motor is actuated to again effect piecing operation as mentioned above.

In the case where a yarn is present as a result of redetection of yarns by the sensors SE1 to SE4, the relay RA8 is actuated by the switch RA7-2 to start the winding drum to start winding similarly to the case where piecing is completed by one piecing operation.

If piecing is unsuccessful by one piecing operation, the relay RA7 is inoperative similarly to that as described above, and therefore the switch RA7-4 is turned on and the switch RA6-3 is turned on by actuation of the relay RA6 to actuate the cutter so that yarns are again cut and pieced together and the relay RA9 is actuated. If the relay RA9 is set so as to provide a knot stop signal by suitable number of operations, for example, three times of piecing, piecing not more than as needed is to be not repeated. At that time, an alarm may be actuated.

As described above, all the signals from the sensors 503, 504, 505 and 506 are inputted into the control system, that is, only in the case where the presence of yarns are confirmed by all four sensors, a signal for tying yarns is generated.

If there occurs a single yarn due to guide error on the delivery side, two joined yarns due to some reason or separation error on the winding side, it is unavoidable that yarns cannot be detected by one or more sensors among four sensors, and a signal for tying is not provided.

On both feed and winding sides, only when yarns are properly introduced into the precing device, joining is carried out to prevent occurrence of defective piecing.

Figure 21:
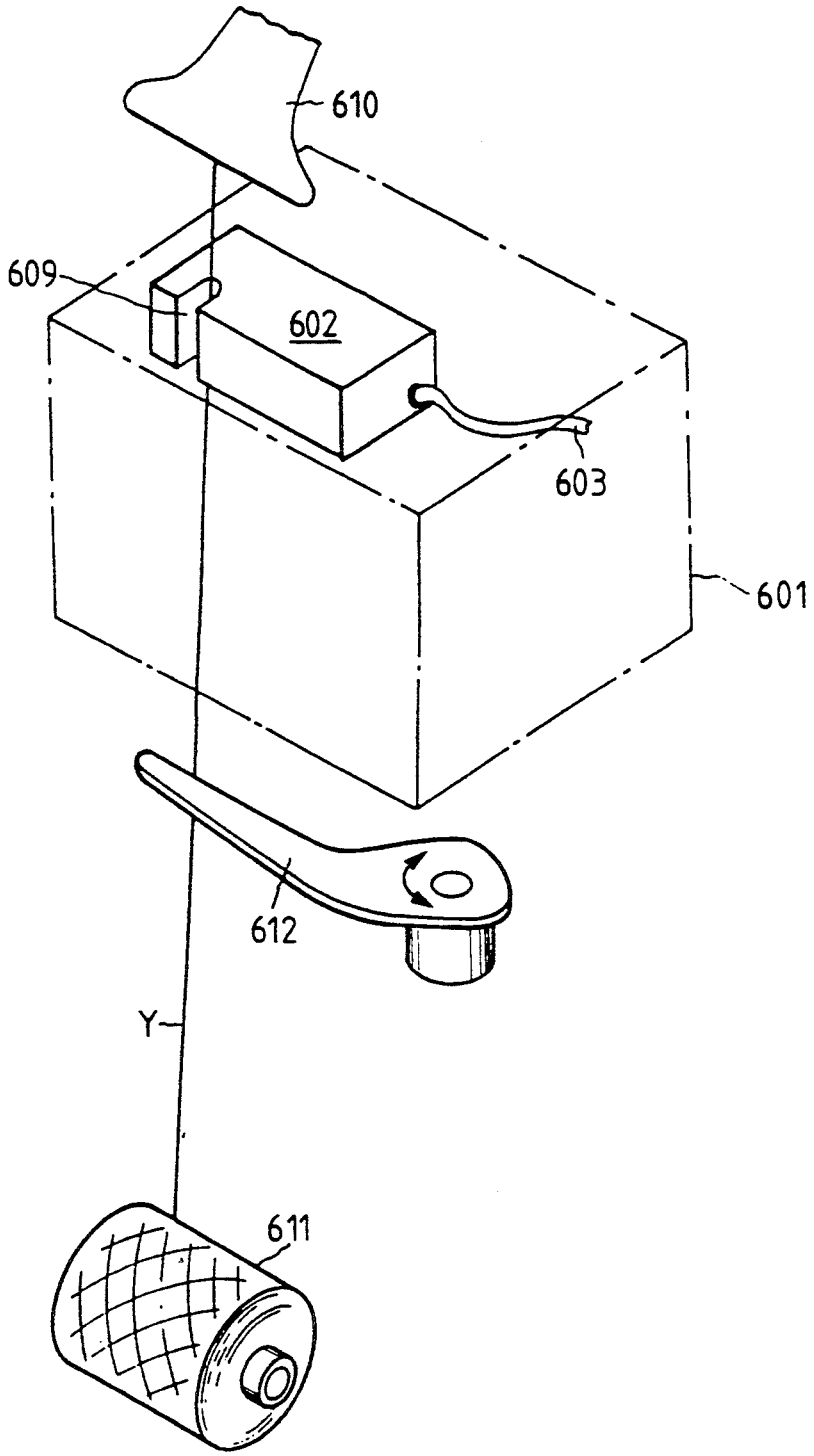
FIG. 21 is a perspective view showing essential parts of an embodiment according to the present invention.
Figure 22:
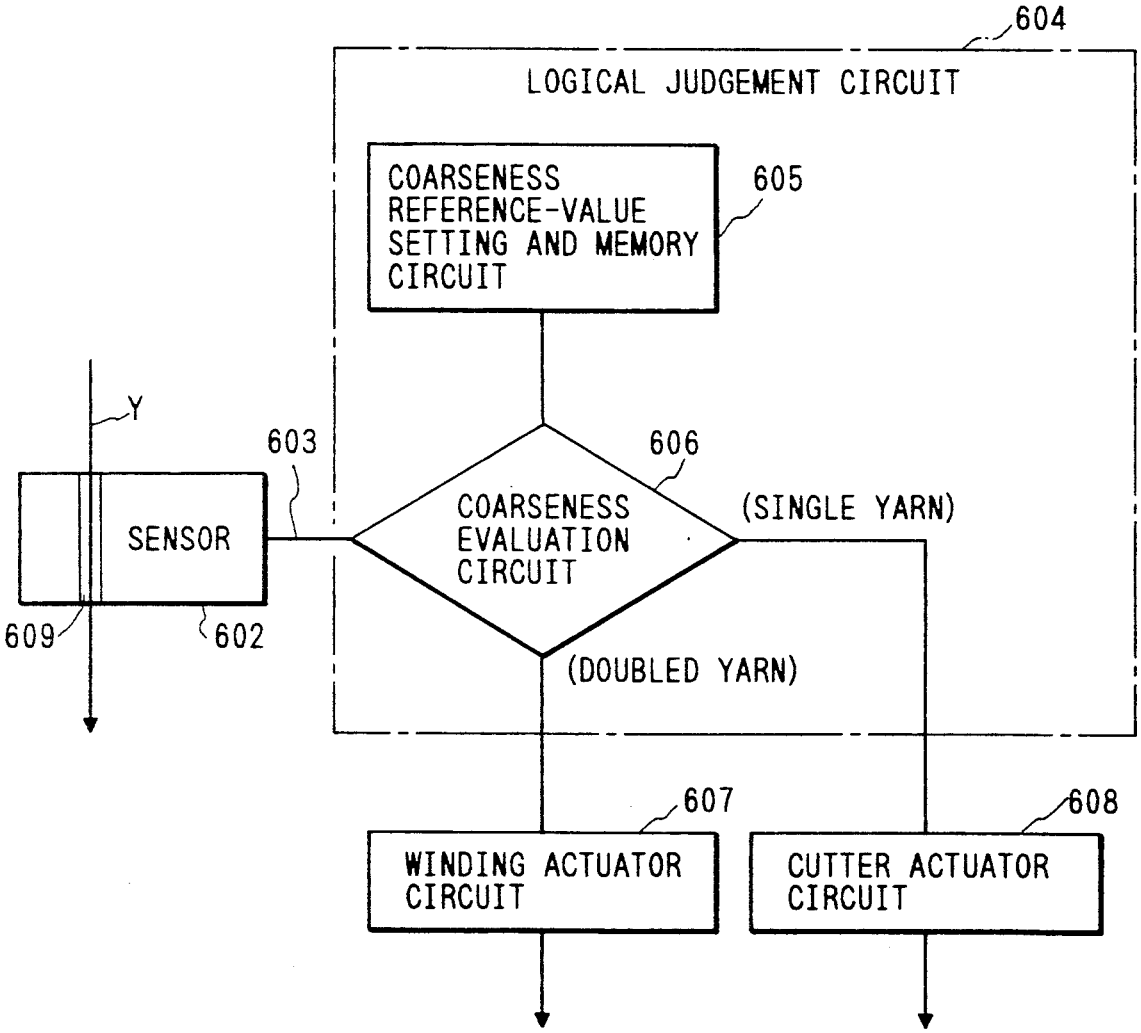
FIG. 22 is a block diagram showing a sensor and a logical evaluation circuit.

Another embodiment of a doubled yarn piecing apparatus will be described referring to FIGS. 21 and 22.

According to a piecing apparatus for doubled yarn of the present invention, a sensor is mounted on a piecing apparatus, said sensor being provided with an evaluation circuit for comparing and discriminating coarseness of yarns on the basis of output thereof, a winding actuating circuit in which either one is actuated according to the evaluation of coarseness by the evaluation circuit and a cutter actuator circuit, whereby a doubled yarn drawn out of a package for piecing and guided to a piecing apparatus is introduced into a sensor for evaluation of coarseness. When said coarseness evaluation circuit does not detect a coarseness corresponding to the doubled yarn, a cutter actuator circuit for actuating a cutter provided in the midst of a yarn running passage is actuated, and when the mode is reversed to the former, a winding actuating circuit is actuated.

In the piecing apparatus, those other than a measuring portion among the coarseness evaluation device, that is, a logic evaluation circuit and the like may be provided at a suitable location away from the piecing apparatus, for example, within a control device of the whole piecing apparatus.

In the piecing apparatus of the present invention, yarns subjected to pick finding, i.e. the yarn end on a wound package is found and pulled from the wound package are introduced to the piecing apparatus, and into the coarseness discriminating device for evaluation of coarseness. When the discriminating device detects a coarseness of a yarn corresponding to a doubled yarn, the piecing proceeds, and otherwise judgement is made so that abnormal pick finding in which only a single yarn is drawn out is present and the piecing is restarted or stopped. Thereby, the abnormal piecing is avoided.

In the shown embodiment, a sensor 602 of a coarse discriminating device is provided immediately above a piecing apparatus body 601. The sensor 602 is connected to a logical evaluation circuit 604 by a cable 603. The logical evaluation circuit 604 comprises a reference value setting and memory circuit 605 for coarseness and a coarseness evaluation circuit 606 for comparing an output signal of the sensor with a reference value stored in the memory circuit 605, and is connected to a winding actuator circuit 607 for actuating winding of a package on the basis of an output signal of the evaluation circuit 606 and a cutter actuator circuit 608 for actuating a cutter, said circuits being stored in the control device of a whole piecing apparatus not shown.

The sensor 602 may be of known sensors such as an electrostatic capacity type, an optical system or the like, and has a sensitivity which can discriminate between a doubled yarn normally spun and single yarns constituting the doubled yarn. The sensor 602 has a vertically extending yarn guide groove 609 in front thereof, mounting position of which is selected so that a package 611 is drawn out by a suction mouth 610 having a turning function, and the yarn guide groove 609 is opposed to a yarn Y guided by the piecing apparatus body 601.

A guide lever 612 is provided close to the running path of the yarn Y, so that after the yarn is drawn out, the lever can turn to push the yarn Y located in front of the yarn guide groove 609 into the inner part of the groove 609.

The piecing apparatus body 601 is basically of a known piecing apparatus.

During piecing, the suction mouth 610 downwardly turns to suck a yarn end of the package 611, raise the drawn yarn end and guide it to the piecing apparatus body 601. In the normal piecing apparatus, immediately thereafter, the yarn end sucked and guided by a suction tube from an upper spinning unit is guided by the piecing apparatus body 601 to start piecing. At this time, however, evaluation of coarseness of the yarn Y is carried out. That is, the lever 612 turns to push the yarn Y into the inner part of the yarn guide groove 609 of the sensor 602 and a coarseness of the yarn Y is detected by the sensor. A signal in connection with the coarseness of the yarn Y is fed to the logical evaluation circuit 604 of the coarseness evaluation device and is compared, in the coarseness evaluation circuit, with a reference value of coarseness of the doubled yarn stored in advance. The reference value is not a standard value of coarseness of a doubled yarn being spun but is smaller than a lower limit value of variation of coarseness which normally occurs and is a value sufficiently larger than coarseness of single yarns constituting a doubled yarn. When the coarseness of the detected yarn Y is larger than the reference value, judgement is made that the yarn is a doubled yarn, and the coarseness evaluation circuit 6 provides a signal to actuate the winding actuator circuit 607. When the coarseness of the detected yarn Y is smaller than the reference value, judgement is made so that only a single yarn is subjected to pick finding, and the coarseness evaluation circuit 606 provides a signal of a single yarn to actuate the cutter actuator circuit 608, for example, actuate a cutter of a slub catcher so that piecing operation starting pick finding is again effected. When abnormal pick finding is not overcome even by performing re-operation a few times, an alarm provides to stop piecing operation.

The piecing apparatus according to the present invention is provided with an abnormal pick-finding detection device configured as mentioned above to thereby positively detect, prior to starting of piecing, the abnormal pick finding in which two single yarns constituting a doubled yarn are not drawn out of the package at the same time and to perform re-operation of piecing for itself, stoppage or issuance of alarm. Therefore, it is possible to prevent troubles which likely occur in the case where piecing is forcedly carried out despite the abnormal pick finding, and to markedly reduce abnormal winding in the doubled yarn package to improve quality of doubled yarn.

What is claimed is:

1. An apparatus for separating a doubled yarn, the doubled yarn comprising a first yarn and a second yarn, the apparatus comprising:

positioning means for positioning the doubled yarn at a predetermined position, separating means for separating the doubled yarn at the predetermined position, the separating means comprising first clamping means for clamping the first yarn with a first firmness and for clamping the second yarn with a second firmness, the first firmness being relatively greater than the second firmness, and first moving means for moving the first clamping means away from the predetermined position to thereby separate the first yarn and the second yarn.

2. The apparatus of claim 1, further comprising:

second clamping means for clamping the first yarn with a first firmness and for clamping the second yarn with a second firmness, the second firmness being relatively greater than the first firmness, and second moving means for moving the second clamping means away from the predetermined position to thereby separate the second yarn and the first yarn.

3. An apparatus of claim 1, wherein the positioning means comprises a yarn guide groove for guiding the doubled yarn to the predetermined position.

4. The apparatus of claim 1, further comprising:

holding means for holding the first and second yarns at second and third positions, respectively, after the first and second yarns have been separated.

5. A method of separating a doubled yarn, the doubled yarn comprising a first yarn and a second yarn, the method comprising the steps of:

positioning the doubled yarn in a first position;

providing a first clamper for clamping yarn;

clamping the first and second yarns with the first clamper, the first yarn being more firmly clamped than the second yarn; and moving the first clamper away from the first position, whereby the first yarn and second yarns are separated.

6. The method of claim 18, further comprising the steps of:

providing a second clamper for clamping yarn;

clamping the first and second yarns with the second clamper, the second yarn being more firmly clamped than the first yarn; and moving the second clamper away from the first position, whereby the first yarn and second yarns are separated.

7. The method of claim 19, further comprising the steps of:

providing a first yarn guide; and moving the first yarn guide to a position adjacent the first clamper and the doubled yarn, and moving the first yarn guide in spaced relation to the first clamper as the first clamper moves away from the first position.

8. The method of claim 20, wherein the first yarn guide defines a yarn engaging groove for engaging yarn, the method further comprising the step of engaging the first yarn with the yarn engaging groove as the first clamper moves away from the first position.

9. The method of claim 20, further comprising the steps of:

providing a second yarn guide; and moving the second yarn guide to a position adjacent the second clamper and the doubled yarn, and moving the second yarn guide in spaced relation to the second clamper as the second clamper moves away from the first position.

10. The method of claim 21, wherein the second yarn guide defines a yarn engaging groove for engaging yarn, the method further comprising the step of engaging the second yarn with the yarn engaging groove as the second clamper moves away from the first position.

11. An apparatus for separating a doubled yarn, the double yarn comprising a first yarn and a second yarn, the apparatus comprising:

positioning means for positioning the doubled yarn at a first predetermined position, separating means, movable in first and second directions, for separating the doubled yarn at the predetermined position and moving the first and second yarns away from each other, releasing means for releasing the first and second yarns from the separating means after the first and second yarns have been moved away from each other, and holding means, moveable in the first and second directions and in spaced relation to the separating means, for holding the first and second yarns at second and third predetermined positions, respectively, after the first and second yarns have been separated and released.

* * * * *